US008023862B2

(12) United States Patent
Miyamoto et al.

(10) Patent No.: US 8,023,862 B2
(45) Date of Patent: Sep. 20, 2011

(54) BELT TRANSFER TYPE IMAGE FORMING APPARATUS

(75) Inventors: Teruyuki Miyamoto, Osaka (JP); Tomohide Hozono, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 107 days.

(21) Appl. No.: 11/861,148

(22) Filed: Sep. 25, 2007

(65) Prior Publication Data

US 2008/0080908 A1 Apr. 3, 2008

(30) Foreign Application Priority Data

Sep. 28, 2006 (JP) ..... 2006-265545

(51) Int. Cl.
*G03G 15/00* (2006.01)

(52) U.S. Cl. ..... 399/162; 399/71

(58) Field of Classification Search ..... 399/149, 399/128, 129, 55, 71, 162
See application file for complete search history.

(56) References Cited

U.S. PATENT DOCUMENTS

| | | | | |
|---|---|---|---|---|
| 5,021,834 | A * | 6/1991 | Tsuruoka et al. | 399/249 |
| 5,655,205 | A * | 8/1997 | Ziegelmuller et al. | 399/350 |
| 6,016,415 | A * | 1/2000 | Herrick et al. | 399/162 |
| 6,292,637 | B1 * | 9/2001 | Lindblad et al. | 399/99 |
| 6,668,149 | B2 * | 12/2003 | Omata et al. | 399/303 |
| 2003/0170039 | A1 * | 9/2003 | Taguchi et al. | 399/66 |
| 2004/0165909 | A1 * | 8/2004 | Asaoka et al. | 399/116 |
| 2005/0286930 | A1 * | 12/2005 | Sawai et al. | 399/167 |

FOREIGN PATENT DOCUMENTS

| | | | |
|---|---|---|---|
| JP | 60144780 | A * | 7/1985 |
| JP | 05-232764 | | 9/1993 |
| JP | 2005-321552 | | 11/2005 |

* cited by examiner

*Primary Examiner* — David Gray
*Assistant Examiner* — G. M. Hyder
(74) *Attorney, Agent, or Firm* — Hogan Lovells US LLP

(57) ABSTRACT

An unit is provided with a friction member which is disposed at a position that is on a downstream side of a drive roller driving a belt and is on an immediate upstream side of a position sensor. The friction member wipes off contaminants adhering to a rear surface of the running belt, thereby constantly keeping the rear surface clean, and therefore, no toner scatters to the sensor. Further, the friction member gives a moderate tension to the belt, so that the posture of the belt is stabilized at a position where it passes the sensor, resulting in enhanced detection accuracy of the sensor.

10 Claims, 6 Drawing Sheets

PRESENT INVENTION

COMPARATIVE EXAMPLE

BELT TRANSFER TYPE IMAGE FORMING APPARATUS

BACKGROUND OF THE INVENTION

1. Field of the Invention

The present invention relates to an image forming apparatus forming an image by using a belt member.

2. Description of the Related Art

An image forming apparatus of this type is disclosed in Japanese Patent Application Laid-open No. Hei 5-232764. This belt member is a photosensitive belt having light transmittancy. This photosensitive belt has no seam, is supported by a drive roll and a tension roll, and runs with the rotation of the drive roll. Around the photosensitive belt, toner developing units are disposed. An electrostatic latent image formed on a front surface of the photosensitive belt is developed with a toner to become a toner image.

Further, Japanese Patent Application Laid-open No. 2005-321552 discloses an apparatus developing a color image on a photosensitive belt. In this apparatus, four developing units for color development are used. The developing units for the respective colors are arranged so as to be capable of coming into contact with the photosensitive belt, and latent images formed on a front surface of the photosensitive belt are developed with color toners. These toner images are sequentially overlaid one on another on an intermediate transfer belt, and one composite color image is transferred to a paper.

Here, each of the aforesaid publications describes that the toner adheres to a rear surface of the photosensitive belt to contaminate the photosensitive belt as the toner image is formed on the photosensitive belt. In each of the publications, a cleaning member is disposed on the rear surface side of the photosensitive belt, and this cleaning member scrapes off the toner on the rear surface of the photosensitive belt as the photosensitive belt runs, thereby removing contaminants on the photosensitive belt.

The contaminants on the photosensitive belt pointed out in Japanese. Patent Application Laid-open No. Hei 5-232764 impairs the light transmittancy of the photosensitive belt to cause poor exposure, which becomes a cause of deteriorating image quality. The contaminants on the photosensitive belt pointed out in Japanese Patent Application Laid-open No. 2005-321552 causes poor grounding of the photosensitive belt and thus becomes a cause of the occurrence of an abnormal image due to insufficient destaticization. Therefore, in both of these publications, it is necessary to remove the contaminants in order to maintain image quality.

In other words, in a case where contaminants on a belt member do not become a cause of deteriorating image quality, a cleaning member is not necessary. For example, in Japanese Patent Application Laid-open No. 2005-321552, the cleaning member, though provided on the photosensitive belt, is not provided on the intermediate transfer belt. This is because, in the intermediate transfer belt in the latter publication, the adhesion of a certain amount of the toner to a rear surface of its transfer surface is not thought to become a cause of deterioration in image quality, provided that the transfer surface has been cleaned.

However, in executing, for example, a transfer process following an image forming process, the toner adhering to the rear surface of this transfer surface gives rise to a problem in the execution of the transfer process in a case where an optical sensor is used to detect the position of the intermediate transfer belt. Specifically, the adhering toner, if scatters, contaminates a light emitting surface and a light receiving surface of the sensor to cause a failure in the detection of the position of the intermediate transfer belt. This does not necessarily become a cause of deterioration in image quality, but is sure to give rise to a problem in the execution of the transfer process.

SUMMARY OF THE INVENTION

It is an object of the present invention to provide an image forming apparatus in which contaminants on a belt member is removed not only from the viewpoint of simply maintaining image quality but also from a broader viewpoint.

In a first embodiment of the present invention, a toner image is formed by using a belt member running on a predetermined circulation route. In this case, the belt member has, on its front surface, an image formation surface, and a toner image is formed on this surface. At a predetermined position of the circulation route on which the belt member runs, a sensor detecting a position of the belt is disposed. This sensor is used for detecting the position of the belt member when, for example, an image forming process is executed.

In this embodiment, contaminants on a rear surface of the belt member, if any, become a cause of deteriorating image quality. In addition, the contaminants on the belt member, if scattering to the optical sensor, make the detection of the position of the belt member difficult as described above, which gives rise to a problem in the execution of the process.

Therefore, in this embodiment, a friction member is disposed at a position that is on a rear surface side of the image formation surface and is on an upstream side of the position where the sensor is disposed. This friction member generates a frictional force on the rear surface of the belt member as the belt member runs.

This frictional force acts in at least the following two ways. Firstly, the contaminants adhering to the rear surface of the belt member are wiped off. In this case, since the rear surface of the belt member is kept clean, there is no toner scattering from the rear surface toward the sensor, and thus no deterioration in image quality occurs.

Secondly, a tension is given to the belt member at least between a position on the upstream side of the position where the sensor is disposed and a position beyond the sensor, that is, a position on a downstream side of the sensor. Owing to the tension given to the belt member, the displacement such as undulation of the belt member in a thickness direction thereof is difficult to occur at least at a position where the belt member passes the sensor. Specifically, the belt member, when given the tension, becomes strongly tensed, which can prevent the belt member from undulating as it runs.

For example, a case where this sensor is an optical sensor and its optical axis matches the thickness direction of the belt member is assumed. In a case where the belt member has a flap portion extending in a direction intersecting the sensor optical axis at right angles, if the undulation or the like in the thickness direction occurs in the belt member as it runs, the position at which the flap portion intersects and passes the sensor optical axis becomes unstable, which tends to cause variation in results of the position detection by the sensor. On the other hand, in the present invention, the friction member prevents the undulation of the belt member, realizing stable accuracy in the position detection by the sensor.

Regarding this point, another possible way to prevent the undulation or the like of the belt member may be, for example, to dispose a guide member (for example, a roll or the like) on the rear surface side of the belt member, but this increases the number of parts and thus may possibly result in cost increase.

In the present invention, on the other hand, there is no need to provide an additional member for guiding the belt member since the friction member has not only a function of cleaning the rear surface of the belt member but also a function of stabilizing the posture of the belt member.

In another embodiment of the present invention, a plurality of image forming devices are provided, each developing a latent image formed on each image carrier with a toner to form a toner image. In this embodiment, a belt member has a transfer surface running on a predetermined circulation route, with the toner images transferred to the transfer surface, and has a function of transferring a composite toner image from the transfer surface to a paper.

In this embodiment, a sensor detecting a position of the belt is also disposed at a predetermined position of the circulation route on which the belt member runs. This sensor is used for detecting the position of the belt member when, for example, a transfer process following an image forming process is executed.

In this embodiment, even if a certain amount of contaminants adhere to a rear surface of the belt, the contaminants do not easily become a direct cause of deteriorating image quality. However, the contaminants on the belt member, if scattering to the optical sensor, make the detection of its position difficult as described above, which gives rise to a problem in the execution of the transfer process Therefore, in this embodiment, a friction member is also disposed at a position that is on a rear side of the transfer surface and is on an upstream side of the position where the sensor is disposed.

Preferably, the friction member is formed to extend along substantially the whole belt member, in terms of a width direction of the belt member, which is a direction perpendicular to a running direction of the belt member. In this case, since substantially the whole rear surface of the belt member is swept, the rear surface is always kept clean.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

Embodiments of the present invention will be hereinafter described with reference to the drawings.

Figure 1:
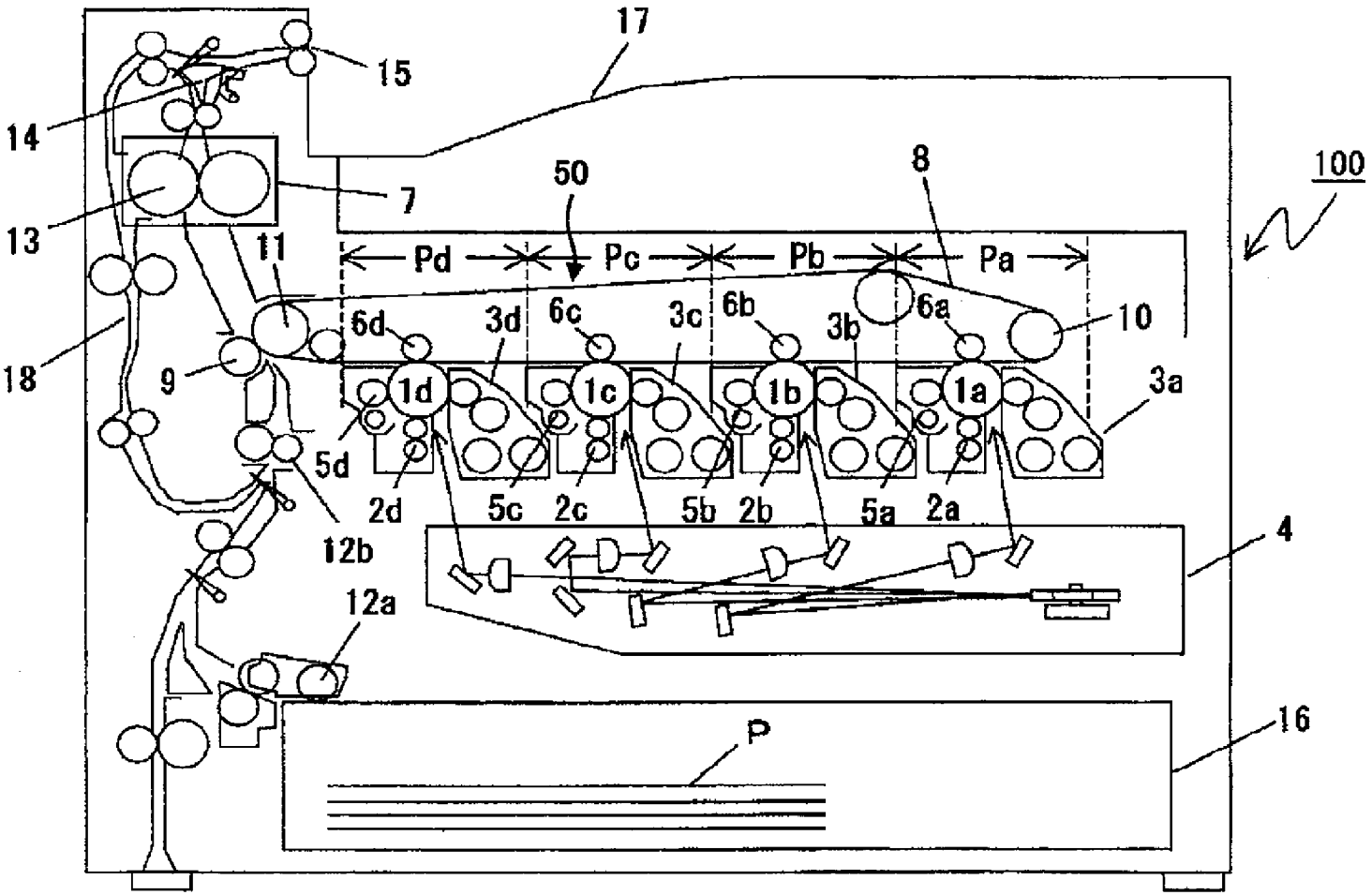
FIG. 1 is a view schematically showing the structure of an image forming apparatus.

FIG. 1 is a schematic view showing the structure of a color image forming apparatus of a tandem type as one embodiment of the present invention. In FIG. 1, the right side is a front side of the image forming apparatus 100, and the left side is a rear side thereof. Therefore, the right and left direction in FIG. 1 matches a front and rear direction of the apparatus 100. FIG. 1 shows a vertical cross section of the apparatus 100 seen from the left direction.

In a main body of the apparatus 100, four image forming devices Pa, Pb, Pc, Pd are provided. These forming devices Pa to Pd are arranged in this order from an upstream side (the right side in FIG. 1) in terms of a feeding direction of a paper P. This direction matches a direction from the front side toward the rear side of the apparatus 100. The four forming devices Pa to Pd are provided so as to correspond to images of four different colors (magenta, cyan, yellow, and black), and sequentially form images of the respective colors, each having processes of charging, exposure, development, and transfer.

The four forming devices Pa to Pd are provided with photosensitive drums (image carriers) 1*a*, 1*b*, 1*c*, 1*d* carrying visible images (toner images) of the corresponding colors respectively. When a drive motor (not shown) rotates counterclockwise in FIG. 1, the toner images formed on the drums 1*a* to 1*d* are sequentially transferred onto an intermediate transfer belt (belt member/hereinafter, simply referred to as a belt) 8 to become a composite color image for one page. Thereafter, this image is transferred at a time onto a paper P at a transfer roller 9, and after the image is further fixed to the paper P in a fuser device 7, the paper P is discharged to the outside of the apparatus 100. In this manner, image forming processes for the drums 1*a* to 1*d* are executed while the drums 1*a* to 1*d* are rotated counterclockwise in FIG. 1.

The paper P to which the toner image is to be transferred is stored in a paper cassette 16 of the apparatus 100, and is fed to the roller 9 via a feed roller 12*a* and a resist roller 12*b*. An endless belt formed of a dielectric resin sheet material with both end portions thereof overlappingly joined to each other or a seamless belt with no seam is used as the belt 8.

Usable examples of the dielectric resin sheet material are high-resistance, dielectric polymer resin sheets such as a polyethylene terephthalate resin sheet (PET sheet) and a polyvinylidene fluoride resin sheet (PVDF sheet), and its specific volume resistivity is $10^{14}$ Ωcm or higher.

Next, the image forming devices Pa to Pd will be described. In the apparatus 100, the photosensitive drums 1*a* to 1*d* are all rotatably provided. An exposure unit 4 is provided under the drums 1*a* to 1*d*. Around the drums 1*a* to 1*d*, charging units 2*a* 2*b*, 2*c*, 2*d*, developing units 3*a*, 3*b*, 3*c*, 3*d*, cleaning units 5*a*, 5*b*, 5*c*, 5*d*, and so on are provided in correspondence to the photosensitive drums 1*a* to 1*d* respectively. Among these, the charging units 2*a* to 2*d* charge the corresponding photosensitive drums 1*a* to 1*d*. The exposure unit 4 exposes the photosensitive drums 1*a* to 1*d* to image data. The developing units 3*a* to 3*d* form toner images on the photosensitive drums 1*a* to 1*d*. The cleaning units 5*a* to 5*d* remove developers (toners) remaining on the photosensitive drums 1*a* to 1*d*.

The image forming process by the apparatus 100 includes the following development process and transfer process. First, in the development process, a signal requesting the start of image formation is inputted to the apparatus 100 from an external apparatus (for example, a personal computer) used by its user. In response to the request, the apparatus 100 first uniformly charges surfaces of the photosensitive drums 1*a* to 1*d* by using the charging units 2*a* to 2*d*, and then causes the exposure unit 4 to irradiate the surfaces of the photosensitive drums 1*a* to 1*d* with laser beams, thereby forming electrostatic latent images corresponding to an image signal, on the surfaces of the photosensitive drums 1*a* to 1*d*. The developing units 3*a* to 3*d* are filled with a predetermined amount of color toners of magenta, cyan, yellow, and black which are supplied from a supply device (not shown). The respective toners are supplied from the developing units 3*a* to 3*d* to the electrostatic latent images formed on the surfaces of the photosensitive drums 1*a* to 1*d* to electrostatically adhere to the surfaces. Consequently, toner images of the respective colors corresponding to the aforesaid electrostatic latent images are developed on the surfaces of the photosensitive drums 1*a* to 1*d* respectively.

The transfer process follows the above-described development process. In this process, after the belt 8 is charged with a predetermined transfer voltage, the magenta, cyan, yellow, and black toner images on the photosensitive drums 1*a* to 1*d* are sequentially overlaid one on another by the intermediate transfer rollers 6*a* to 6*d* (primary transfer). Thereafter, in preparation for the formation of new electrostatic latent images in the next development process, the toners remaining on the surfaces of the photosensitive drums 1*a* to 1*d* are removed by the cleaning units 5*a* to 5*d*.

The belt 8 is supported by a conveyor roller 10 and a drive roller 11 which are provided on an upstream side and a downstream side respectively in terms of the running direction of the belt 8. When the roller 11 is rotated by a drive motor (not shown), the belt 8 rotates clockwise in FIG. 1. The aforesaid transfer roller 9 faces the belt 8 at a position adjacent to the roller 11. Then, when it becomes possible to transfer the toner image from the belt 8 to the paper P (secondary transfer), the paper P is conveyed from the roller 12*b* up to the roller 9 at a predetermined timing. Between the roller 9 and the belt 8, a nip is formed, and when the paper P passes the nip, the composite full color image or monochrome image is transferred to the paper P (secondary transfer). Then, the paper P is conveyed to the fuser device 7.

The paper P in the fuser device 7 is heated and pressed by a pair of fixing rollers 13, so that the toner image is fixed to a surface of the paper P and thus the desired full color image or monochrome image is formed thereon. A branching device 14 branching off in a plurality of directions (two directions here) conveys the paper P selectively in one of the directions. Specifically, in a case where it is necessary to form an image only on one surface of the paper P, the paper P is discharged to a discharge tray 17 by a discharge roller 15.

On the other hand, in a case where images should be formed on both surfaces of the paper P, the paper P after going through the fuser device 7 is partly made to protrude to the outside of the apparatus from the roller 15. Thereafter, by the reverse rotation of the roller 15, the paper P is directed toward a paper conveyance path 18 via the branching device 14 and is conveyed again to the roller 9, with the aforesaid surface bearing the transferred image being inverted. Then, a next image formed on the belt 8 is transferred by the roller 9 to a surface, of the paper P, to which no image has been formed, and this paper P is conveyed to the fuser device 7, where the toner image is fixed thereto, and thereafter the paper P is discharged.

Incidentally, a cleaning device, though not shown in FIG. 1, is provided at a position facing the roller 10. This device cleans the toners and the like adhering to the belt 8.

The foregoing is the description of the basic structure and the image forming operation of the apparatus 100. Though FIG. 1 shows an example where the apparatus 100 is a color printer, the apparatus 100 of this embodiment may be a color copying machine or a color multifunctional machine. In these cases, the apparatus 100 includes an image reading device in addition to the image forming devices Pa to Pd. This reading device has therein, for example, a scanning optical device equipped with a scanner lamp illuminating an original at the time of copying and a mirror changing an optical path of reflected light from the original, and in addition, has therein a condenser lens condensing the reflected light from the original to form an image thereof, and an optical element such as a CCD converting the image-formed light into an electrical signal. An auto sheet feeder (ASP) may be attached to this reading device.

Figure 2:
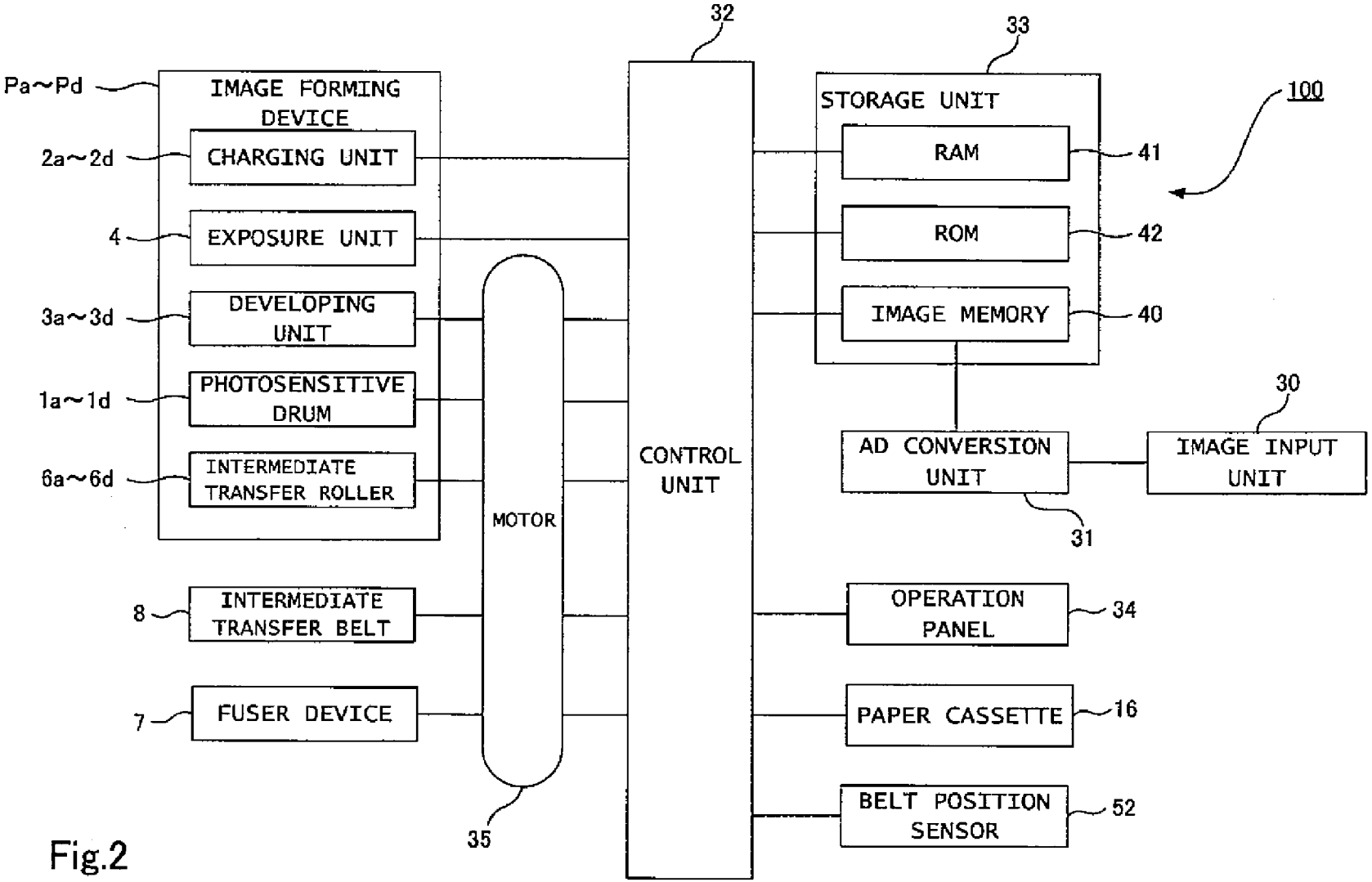
FIG. 2 is a block diagram showing a control line in the image forming apparatus.

FIG. 2 is a block diagram showing control of the apparatus 100. In addition to the aforesaid image forming devices Pa to Pd, fuser device 7, belt 8, and cassette 16, the apparatus 100 includes, as elements of a control line, an image input unit 30, an AD conversion unit 31, a control unit 32, a storage unit 33, an operation panel 34, and so on.

In a case where the apparatus 100 is a copying machine or a multifunctional machine, the input unit 30 has the scanning optical device provided with the scanner lamp and the mirror, the condenser lens, the CCD, and so on which are mentioned above. In a case where the apparatus 100 is a printer, the input unit 30 is a receiving unit receiving image data (an image data group for all the pages) transmitted from a personal computer or the like. A digital image signal inputted to the input unit 30 is sent to an image memory 40 in the storage unit 33. An analog image signal is sent to the memory 40 after converted into a digital image signal in the AD conversion unit 31.

The storage unit 33 includes the memory 40, a RAM 41, and a ROM 42. Among them, the memory 40 is a buffer storing the aforesaid image signals and sending the signals to the control unit 32. The RAM 41 and the ROM 42 store processing programs, processing contents, and the like of the control unit 32.

The panel 34 has an operation unit having a plurality of operation keys and a display unit displaying setting conditions, the state of the apparatus 100, and so on (they are not shown). A liquid crystal display is suitable as the display unit, and the display unit may be a touch panel accepting an operation via its display screen. Such a panel 34 is provided on a surface of an external cover of the apparatus 100, and accepts the setting of print conditions and so on that a user gives by using the operation keys. In addition, in a case where, for example, the apparatus 100 has a facsimile function, the panel 34 is used for registering a facsimile transmission destination in the storage unit 33 and for inputting various settings such as reading and changing the registered transmission destination.

According to control signals from the control unit 32, a main motor 35 in FIG. 2 drives elements such as the photosensitive drums 1*a* to 1*d*, the developing units 3*a* to 3*d*, and the intermediate transfer rollers 6*a* to 6*d*, which are included in the forming devices Pa to Pd, the belt 8, the fuser device 7, and so on. To drive or stop only one of the elements, the motor 35 is connected or disconnected to/from a clutch (not shown) provided between the motor 35 and each of the elements. Incidentally, to drive the elements independently of one another, specialized motors may be connected to the respective elements.

Further, the control unit 32 transmits a control signal to a drive motor (not shown) for the feeding of a paper which is to undergo the transfer process and for the conveyance and discharge of a paper which has undergone the transfer process. By controlling the rotation state of this motor, the rotation states of the rollers 12*a*, 12*b*, 15 and so on mentioned above are controlled.

According to set programs, the control unit 32 comprehensively controls the input unit 30, the forming devices Pa to Pd, the fuser device 7, and so on, and in addition, converts an image signal sent from the input unit 30 into image data by performing variable magnification processing or tone processing as required. The converted image data is further processed into four image data of the respective magenta, cyan, yellow, and black colors in order to form a color image. The data of the respective colors are individually transmitted to the corresponding forming devices Pa to Pd. To the forming devices Pa to Pd, the exposure unit 4 emits laser beams corresponding to the respective forming devices based on the data transmitted from the control unit 32, thereby forming latent images on the surfaces of the respective photosensitive drums 1*a* to 1*d*.

Meanwhile, from the forming devices Pa to Pd, synchronizing signals are transmitted to the control unit 32 respectively. Each of these synchronizing signals is used by the control unit 32 for the synchronization of the transmission timing of the image data of each of the colors. In this embodiment, because of the arrangement, the forming device Pa corresponding to magenta first forms the toner image on the belt 8, and subsequently, the forming device Pb corresponding to cyan, the forming device Pc corresponding to yellow, and finally the forming device Pd corresponding to black overlay the toner images of the respective colors on the belt 8 in this order, Therefore, the synchronizing signals for magenta, cyan, yellow, and black are transmitted to the control unit 32 in this order. Then, upon receipt of the synchronizing signals for the respective colors in sequence, the control unit 32 transmits the image data of the respective colors to the forming devices Pa to Pd in order in which the synchronizing signals are received.

Besides, the control unit 32 has a function of calculating a print ratio, line width, and so on of a printing image based on the image data stored in the memory 40. The control unit 32 also adjusts developing bias of the developing units 3*a* to 3*d* based on the calculated print ratio.

The foregoing has described the operation for ordinary printing, and in the apparatus 100 of this embodiment, there are cases where calibration is performed on the belt 8. The calibration is a maintenance operation for automatically adjusting, for example, toner concentration and overlaying conditions of the respective colors. To adjust the toner concentration, for example, a toner image transferred to a front surface (transfer surface) 8A (to be described later) of the belt 8 is read by an optical sensor (not shown). Then, toner concentration of the image actually developed on this front surface 8A and concentration indicated by original image data stored in the memory 40 are compared, and a concentration difference therebetween is corrected. If the actual toner concentration on the front surface 8A differs from the color concentration indicated by the original image data, the control unit 32 adjusts the developing bias to correct the concentration difference.

At the time of the calibration, it is necessary to stabilize a read value of the aforesaid optical sensor (a detection value of the toner concentration on the front surface 8A). Therefore, a toner image for adjustment is always transferred to a fixed position in terms of the running direction of the belt 8. This is because, due to unevenness in the running direction in the state of the front surface 8A (in particular, color on the front surface 8A) of the belt 8, values read by the aforesaid optical sensor from a toner image transferred to a relatively high light-reflectance position of the front surface 8A and from a toner image transferred to a relatively low light-reflectance position of the front surface 8A differ from each other.

Therefore, in this embodiment, a sensor 52 detecting the position of the belt 8 is provided as a member for detecting a position, of the belt 8, which serves as a reference in the calibration. The sensor 52 is provided at a fixed position (predetermined position) on a circulation route of the belt 8, and when detecting that a specific portion of the front surface 8A reaches this position, the sensor 52 outputs a detection signal to the control unit 32. The control unit 32 calculates the position of the belt 8 (for example, a position where the reference position runs) based on the detection signal from the sensor 52.

Figure 3:
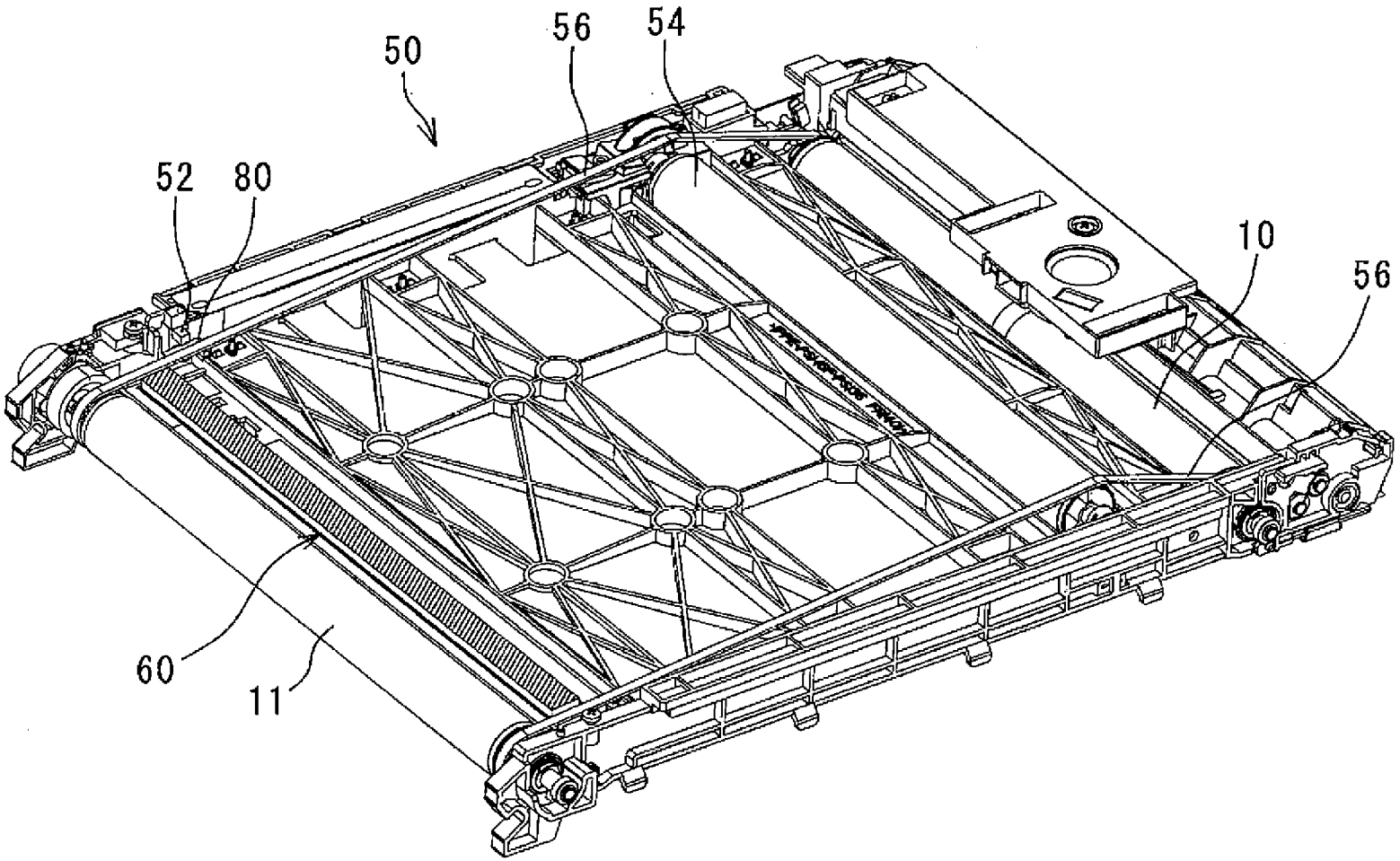
FIG. 3 is a perspective view showing only an intermediate transfer unit seen from diagonally above, with an intermediate transfer belt being removed.

FIG. 3 is a perspective view showing the intermediate transfer unit 50 seen from diagonally above, with the belt 8 being removed from the intermediate transfer unit 50. The intermediate transfer unit 50 is installed in the apparatus 100, being positioned above the four forming devices Pa to Pd (FIG. 1). The intermediate transfer unit 50 mainly drives the belt 8, and under the intermediate transfer unit 50, the front surface 8A of the belt 8 is in contact with the four photosensitive drums 1*a* to 1*d*. Further, at an upper rightward position in FIG. 3, the conveyer roller 10 is disposed, and at a lower leftward position, the drive roller 11 is disposed.

In addition to the abovementioned rollers 10, 11, a tension roller 54 positioned therebetween is provided in the intermediate transfer unit 50. The tension roller 54 is positioned on a slightly upstream side of the conveyor roller 10 in terms of the running direction of the belt 8, and at this position, it guides the running of the belt 8 while lifting up a back surface (rear surface) 8B (to be described later) of the belt 8. Consequently, the belt 8 is given a moderate tension.

Further, as shown in FIG. 3, the intermediate transfer unit 50 is provided with a pair of ribs 56. The ribs 56 are disposed on both sides of the belt 8 respectively, in terms of the running direction of the belt 8, to prevent meandering of the belt 8 (widthwise displacement of the belt 8). When the belt 8 is wound around the rollers 10, 11, 54, inner sides of the ribs 56 support side edge portions 8C of the belt 8 (FIG. 5) to prevent the meandering of the belt 8. Detailed description of these basic structures of the intermediate transfer unit 50 will be omitted here since those publicly known are applicable to all of them.

Figure 4:
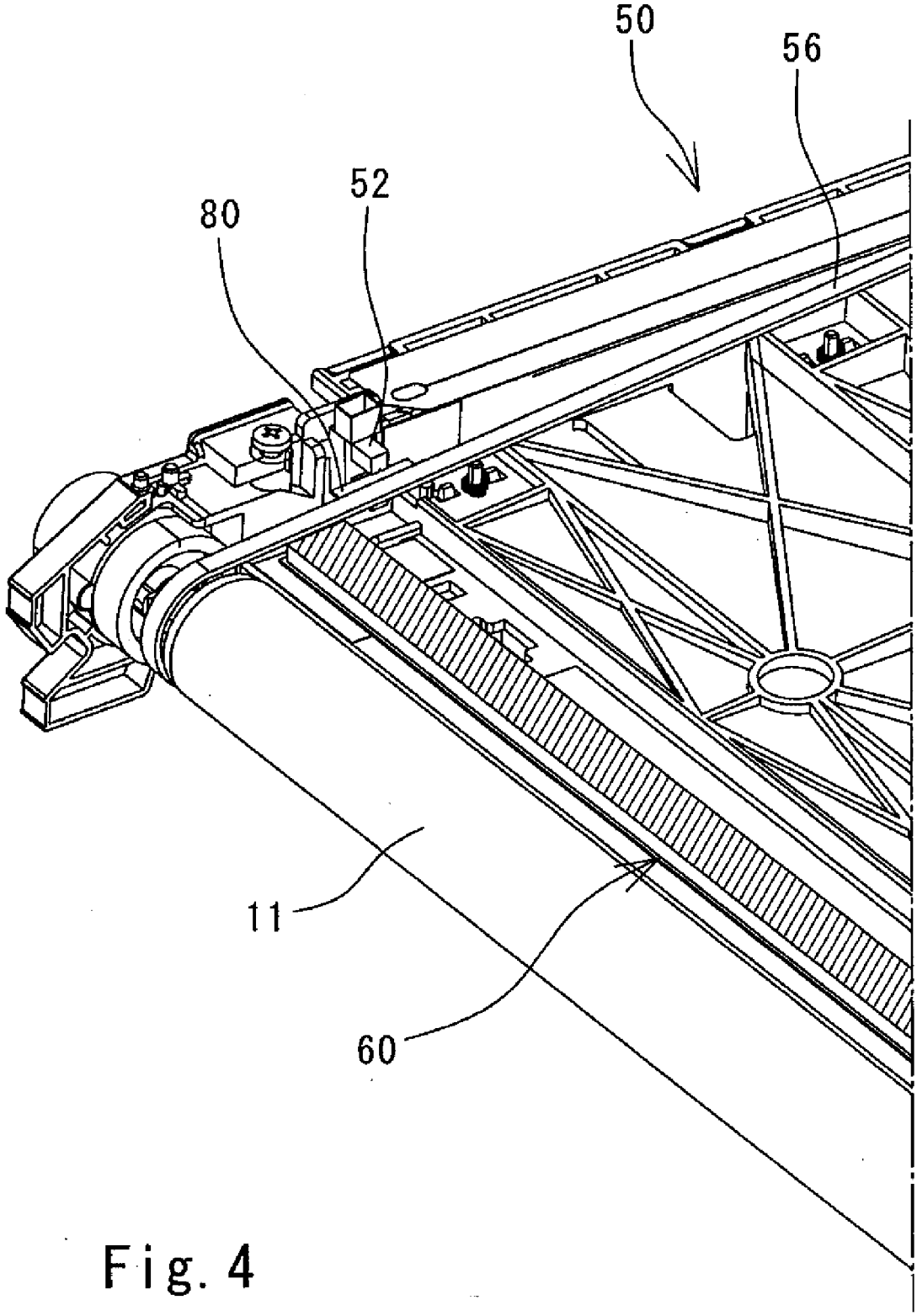
FIG. 4 is a perspective view showing a downstream-side portion of the intermediate transfer unit in detail.

FIG. 4 is a perspective view showing a downstream-side portion of the unit 50 in detail. The downstream side mentioned here means a downstream side in terms of the running direction of the belt 8 on a side where the toner images are transferred from the forming devices Pa to Pd. Therefore, after the front surface 8A of the belt 8 is inverted by moving along the roller 11, the front surface 8A is exposed on an upper surface side shown in FIG. 3 and FIG. 4, and the belt 8 runs from the roller 11 toward the roller 10. Therefore, in a view seen from the upper surface side in FIG. 3 and FIG. 4, the roller 11 is positioned on the upstream side of the roller 54 and the roller 10 is positioned on the downstream side of the roller 54. In the description below, the upper stream side and the downstream side mean those in a view seen from the upper side shown in FIG. 3 and FIG. 4, unless otherwise mentioned.

The aforesaid sensor 52 is disposed on the downstream side of the roller 11. The sensor 52 is formed by, for example, a transmissive spot beam sensor, and in its installation state, a sensor optical axis is set along a thickness direction (here, an up and down direction) of the belt 8. In this embodiment, the sensor 52 is disposed on a further left side of the side edge portion 8C of the belt 8, that is, the side edge portion 8C disposed at an upper left position in FIG. 4. Its optical axis is set at a position apart from the belt 8 so as to extend in a direction connecting the front surface 8A and the rear surface 8B of the belt 8.

Here, a rectangular marking flap (flap portion) 80 is attached to the belt 8 which is not shown in FIG. 3 and FIG. 4. In more detail, the flap 80 is formed by, for example, a flexible black film piece, and has a certain length in the running direction of the belt 8 which is its longitudinal direction.

Further, the flap 80 is fixed at a predetermined position on the left side of the belt 8 in terms of the running direction of the belt 8, and protrudes toward an outer side from the side edge portion 8C of the belt 8 by a length long enough to intercept the sensor beam of the sensor 52 as the belt 8 runs, As shown in FIG. 3 and FIG. 4, when the flap 80 passes the installation position of the sensor 52 as the belt 8 runs, the sensor beam is intercepted by the flap 80. Since a sensor signal of the sensor 52 becomes off during this period, the control unit 32 detects that the reference position of the belt 8 has reached the position of the sensor beam of the sensor 52 based on a change (on to off) of the sensor signal.

In the structure of the intermediate transfer unit 50, information on the total length of the belt 8, the installation position of the sensor 52 relative to the running route of the belt 8, and so on has been known. Therefore, using a change in the detection signal of the sensor 52 as an index, the control unit 32 counts the number of driving pulses that the motor 35 outputs after the this change, thereby capable of easily calculating at which position on the running route the reference position of the belt 8 is currently running, or how much the reference position of the belt 8 has advanced from the reference point on the running route.

As described above, at the time of the aforesaid calibration, the control unit 32 specifies the position of the belt 8 based on the detection signal of the sensor, thereby capable of making adjustment of the toner concentration (color resist) at the same fixed position.

Here, the present inventor has the following findings regarding a cause of a detection failure of the sensor 52. Specifically, it has been found out that, though the installation position of the sensor 52 is on the outer side of the belt 8, if the toner adhering to the rear surface 8B of the belt 8 scatters around, it contaminates the light emitting surface and the light receiving surface of the sensor 52 to cause the detection failure of the sensor 52. Therefore, in this embodiment, based on the above unique findings of the present inventor, the following structure is provided as a means for preventing the toner from adhering to the rear surface 8B of the belt 8.

In the intermediate transfer unit 50, a friction member 60 is disposed between the drive roller 11 and the sensor 52, that is, at a position on the upstream side of the sensor 52. The friction member 60 is made of, for example, a material having high-density fine fibers raised in one direction. Hatched portions in FIG. 3 and FIG. 4 are a friction area formed by tips of the raised fibers, The individual fibers try to be restored to the original posture so as to keep raised as much as possible when the tips thereof are scrubbed, and consequently, their restoring forces gather to be able to generate a large frictional force.

Further, the friction member 60 of this embodiment is formed along substantially the whole belt 8 in a direction perpendicular to the running direction of the belt 8, that is, in the width direction of the belt 8, and has a certain length along the running direction of the belt 8. In this embodiment, the friction member 60 is disposed so as to fill the whole gap between the aforesaid pair of ribs 56

Figure 5:
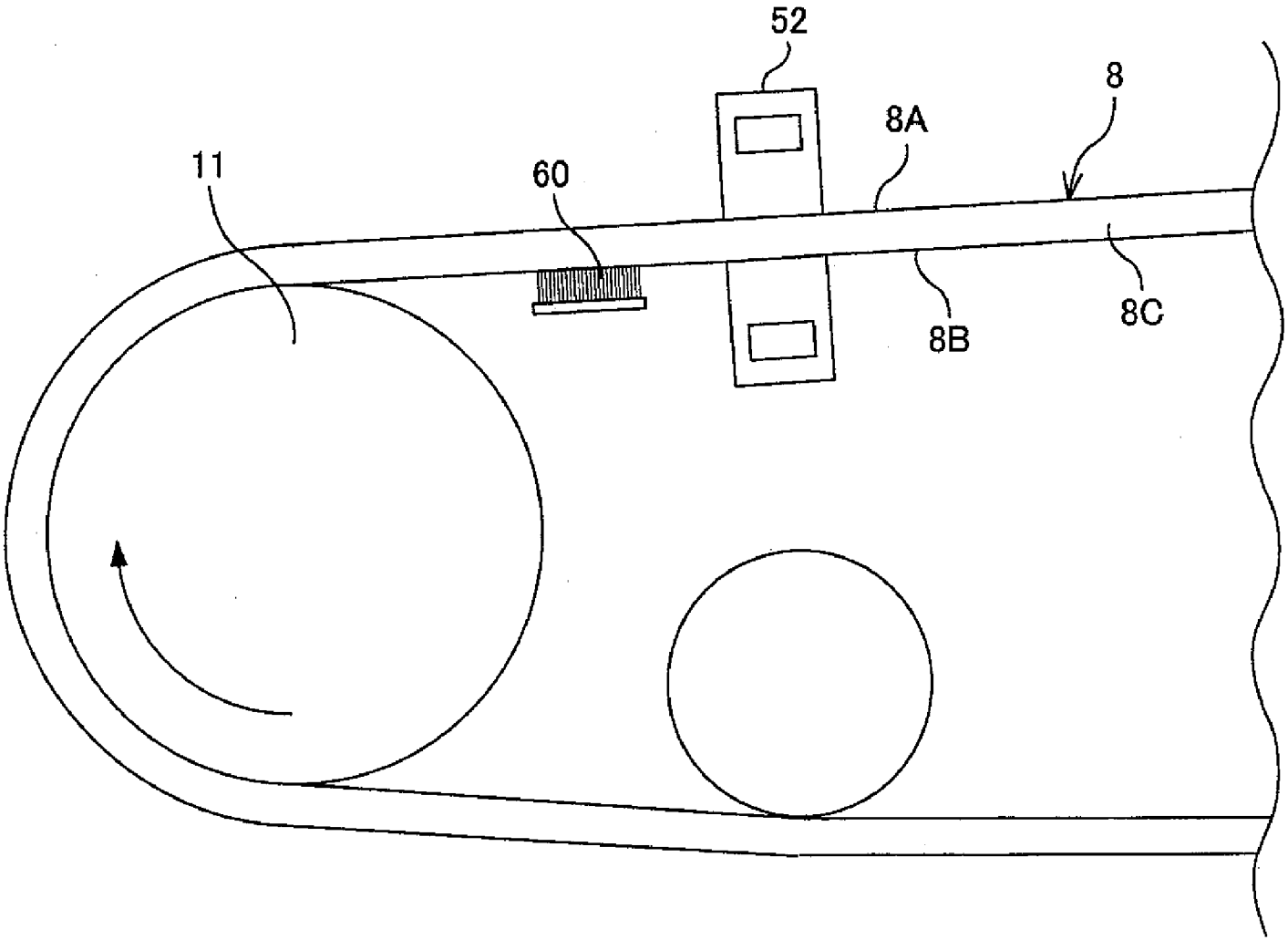
FIG. 5 is a view schematically showing a vertical cross section of an upstream-side portion of the intermediate transfer unit.

FIG. 5 is a view schematically showing a vertical cross section of an upstream-side portion of the intermediate transfer unit 50. The aforesaid friction member 60 is in the state where its raised tips are in contact with the rear surface 8B of the belt 8. Therefore, when the belt 8 runs clockwise in FIG. 5 in accordance with the rotation of the drive roller 11, the friction member 60 generates the frictional force on the rear surface 8B of the belt 8 while being in contact with the rear surface 8B.

Then, the friction member 60 works to wipe off the toner adhering to the rear surface 8B of the belt 8, thereby sweeping (cleaning) the rear surface 8B. This prevents the toner from being left adhering to the rear surface 8B. In addition, it can be prevented that the light emitting surface and the light receiving surface of the sensor 52 are contaminated due to the scattering of the toner adhering to the rear surface 8B.

Especially because the friction member 60 is disposed at the position on the immediate upstream side of the sensor 52 in this embodiment, the rear surface 8B is always cleaned at the position immediately before the position where it passes the sensor 52. Therefore, when the belt 8 passes the sensor 52, there is no toner left adhering to the rear surface 8B, which more surely prevents the scattering of the toner to the sensor 52.

In this embodiment, the following product is provided as an example of a product suitable for the above-described friction member 60.

Name: pile fabric (general name)
Manufacturer: Toci Sangyo Co, Ltd.
Product use: brush
Product No.: ULUN 6D
Brush density: 120 kF/inch$^2$
Fineness: 330T/48F
Size: 300 mm length×15 mm width×5 mm height
Others: a penetration amount of brush tips in a transfer belt is about 2 mm (design value)

The above product (brush) made of the pile fabric presented as an example is a publicly known product which has been generally used as a cleaning brush in image forming apparatuses of this type, and is relatively easily available in implementing the present invention. Generally, pile fabric is formed of a ground fabric woven in a planar form (X-Y plane) with warp and weft yarns, and pile yarns raised (in a Z-axis direction) from the ground fabric.

In a publicly known cleaning brush, a pile yarn is generally made of a filament yarn (long fabric yarn). Each filament yarn is a bundle of a plurality of filaments. This yarn is called "a multifilament yarn". A single filament is an ultrafine fiber with an about 1 mm diameter.

The aforesaid brush density (120 kF/INCH$^2$) means that the number of the filaments existing on the aforesaid ground fabric is 120,000 per 1 square inch. The fineness (330T/48F) means that one filament yarn consists of a bundle of 48 filaments and the thickness of one bundle is 330 decitex. The decitex is an index equivalent to mass (gram) of a yarn with a 10,000 m length. In the above case, one filament when stretched to 10,000 m has a mass equivalent to 330 grams.

Generally, to use a pile fabric for a cleaning brush, a belt-shaped fabric is spirally wound around a shaft to be formed into a brush shape. In this embodiment, a fabric is stretched in a belt shape for use, thereby being usable as the aforesaid friction member 60. For use as the friction member 60, the fabric (a rear surface of the ground fabric) has to be bonded to a plate-shaped member so as to be supported thereby.

The fabric has a 300 mm width, which corresponds to a width of the belt 8. Since the fabric has a 15 mm length, the friction member 60 comes into contact with the rear surface 8B of the belt 8 within a 15 mm section in terms of the running direction of the belt 8. The fabric has a 5 mm height, which represents an average height from a bottom surface of the ground fabric to the tips of the pile yarns (filament yarns).

In this embodiment, the friction member 60 is disposed at a position so that the tips of the pile yarns penetrate in the rear surface 8B by about 2 mm. Here, the term "penetrate" does not mean that the pile yarns pierce into the belt 8 but means that the pile yarns elastically deform, with the tips being pressed down by only 2 mm. In this embodiment, the design value of the penetration amount is 2 mm, and therefore, in designing, a bottom surface of the fabric (ground fabric) is set at a position 3 mm apart in a vertically downward direction from the rear surface 8B. Owing to a repulsive force caused by the elastic deformation of the pile yarns at this time, the friction member 60 can generate a moderate frictional force. Further, the friction member 60 can be said to have a sufficient function of cleaning the rear surface 8B since a material used for a cleaning brush in an image forming apparatus is used as its material.

As described above, the cleaning function realized by the use of the friction member 60 surely prevents a detection failure of the sensor 52 in this embodiment. In addition, the present inventor has the following findings. That is, the belt 8 slightly undulates in the thickness direction as it runs, due to its highly flexible soft material, so that the flap 80 is slightly displaced relative to the sensor 52. Due to the displacement of the flap 80 caused by the undulation in the thickness direction of the belt 8, the timing at which a change occurs in the detection signal of the sensor 52 becomes unstable.

Figure 6A:
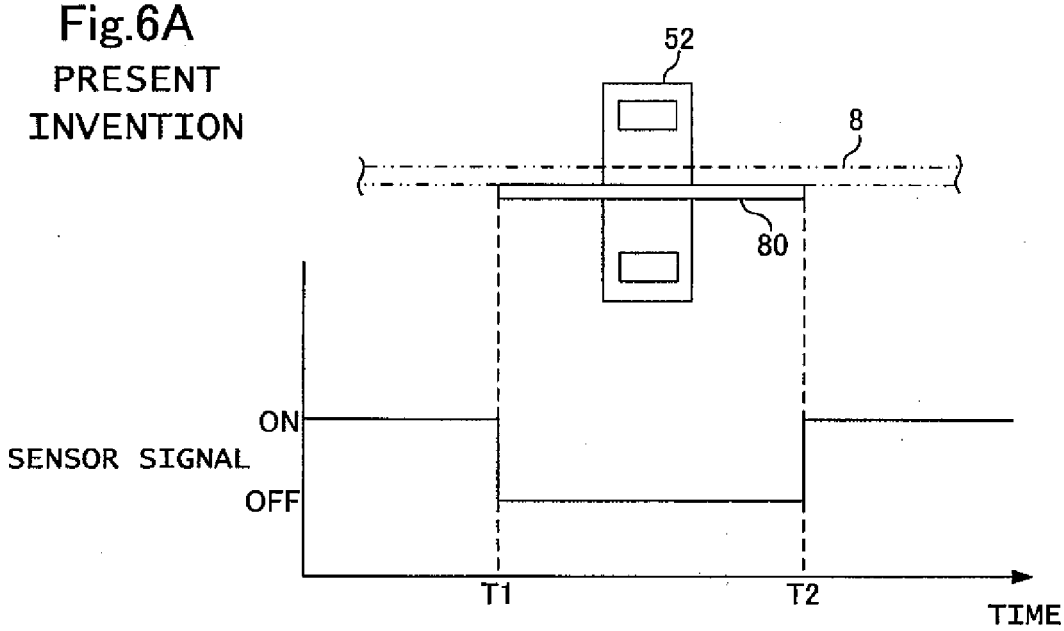
FIGS. 6A and 6B are timing charts showing states when a flap portion passes a sensor, and a change of a sensor signal in accordance with the passage, in the present embodiment and in a comparative example respectively.
Figure 6B:
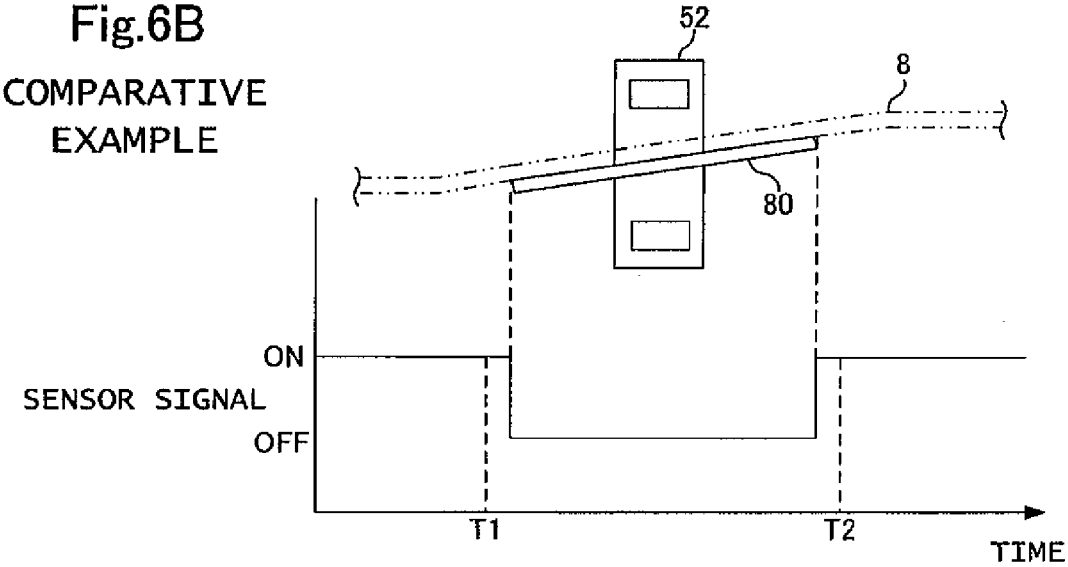

FIGS. 6A and 6B are timing charts showing states when the flap 80 passes the sensor 52 and a change in the sensor signal accompanying the passage. First, in FIG. 6A, which shows the present embodiment, the belt 8 does not undulate in the thickness direction as it runs, and the flap 80 passes the sensor 52 at a predetermined position (position in terms of the up and down direction in this case). Specifically, in this case, the flap 80 makes substantially right angles to the sensor optical axis, and a waveform of the sensor signal outputted from the sensor 52 becomes off at a timing (time T1) when a leading end of the flap 80 in terms of the running direction of the belt 8 intercepts the sensor beam, and becomes on again at a timing (time T2) when a tail end thereof intercepts the sensor beam.

FIG. 6B shows a comparative example as contrast to the above. In this case, the belt 8 undulates in the thickness direction as it runs since the above-described friction member 60 is not provided, and the flap 80 passes the sensor 52 while greatly displaced relative to the sensor 52. Specifically, in this case, for example, on the upstream side of the sensor 52, the posture of the flap 80 makes substantially right angles to the sensor optical axis, while, at the position of the sensor 52, the flap 80 is diagonally displaced from this posture, so that a projected area is smaller at this time by an amount of this displacement than that of the surface making right angles to the optical axis. Consequently, the waveform outputted from the sensor 52 becomes off at a timing later than the proper timing (time T1) at which the leading end of the flap 80 intercepts the sensor beam, and becomes on at an earlier timing than the proper timing (time T2) at which the tail end passes the sensor beam.

The occurrence of such a timing error in the sensor signal of the sensor 52 as in the comparative example disables stable detection in the control unit 32. On the other hand, the friction member 60 of this embodiment can greatly contribute to such a problem.

This is because that the friction member 60 of this embodiment generates the frictional force on the rear surface 8B of the belt 8, thereby giving a tension to the belt 8 between the position on the upstream side of the installation position of the sensor 52 and the position beyond the sensor 52, that is, the position on the downstream side of the sensor 52. Specifically, the tension of the roller 54 lifts up the downstream-side portion of the belt 8 having passed the sensor 52, while the tension of the friction member 60 also lifts a portion of the belt 8 on the upstream side of the sensor 52, which makes it possible to keep the posture of the flap 80 at right angles relative to the sensor optical axis.

As described above, the tension given to the belt 8 by the friction member 60 prevents the belt 8 from undulating in the thickness direction at the position where it passes the sensor 52. This can surely prevent the occurrence of the aforesaid timing error in the waveform of the sensor signal.

The present invention is not limited to the above-described embodiment and can be implemented with various modifications and additions. For example, as previously described, the apparatus 100 may be a color copying machine or a color multifunctional machine, other than a printer.

The image forming apparatus is not limited to a four-tandem full-color type, and may be a monochrome type, provided that it has a structure capable of performing the development and transfer in a plurality of divided operations by using an intermediate transfer member.

In this embodiment, the intermediate transfer belt 8 is shown as an example of the belt member, but the present invention is not limited to this embodiment. That is, the belt member may be a photosensitive belt that itself has an image formation surface corresponding to the aforesaid front surface 8A, and on whose image formation surface a toner image is formed.

What is claimed is:

1. An image forming apparatus comprising:

a belt member having an image formation surface running on a predetermined circulation route, a toner image being formed on the image formation surface;

said belt member including a flap portion protruding outwardly from a side edge portion of said belt member;

a sensor disposed at a predetermined position for detecting the flap portion; and a friction member disposed at a position that is on a rear side of the image formation surface and is on an upstream side, with respect to the running direction, of the predetermined position, wherein said friction member gives said belt member a tension that reduces undulation of the flap portion in a thickness direction of the belt member when the flap portion is being detected by the sensor.

2. The image forming apparatus according to claim 1, wherein said friction member wipes off a contaminant adhering to the rear surface.

3. The image forming apparatus according to claim 1, wherein said friction member is formed along substantially the whole belt member in terms of a width direction of said belt member, which is a direction perpendicular to a running direction of said belt member.

4. The image forming apparatus according to claim 1, wherein said friction member is made of a material having high-density fibers raised in one direction.

5. The image forming apparatus according to claim 1, wherein a tension roller is provided at a position beyond said sensor, which is a position on a downstream side of said sensor when seen in the running direction of said belt member.

6. An image forming apparatus comprising:

a plurality of image forming devices each developing a latent image formed on each image carrier with a toner to form a toner image;

a belt member having a transfer surface running on a predetermined circulation route, the toner images being transferred to the transfer surface, and transferring a composite toner image from the transfer surface to a paper;

said belt member including a flap portion protruding outwardly from a side edge portion of said belt member;

a sensor disposed at a predetermined position for detecting the flap portion; and a friction member disposed at a position that is on a rear side of the transfer surface and is on an upstream side, with respect to the running direction, of the predetermined position, wherein said friction member gives said belt member a tension that reduces undulation of the flap portion in a thickness direction of the belt member when the flap portion is being detected by the sensor.

7. The image forming apparatus according to claim 6, wherein said friction member wipes off a contaminant adhering to the rear surface.

8. The image forming apparatus according to claim 6, wherein said friction member is formed along substantially the whole belt member in terms of a width direction of said belt member, which is a direction perpendicular to a running direction of said belt member.

9. The image forming apparatus according to claim 6, wherein said friction member is made of a material having high-density fibers raised in one direction.

10. The image forming apparatus according to claim 6, wherein a tension roller is provided at a position beyond said sensor, which is a position on a downstream side of said sensor when seen in the running direction of said belt member.

* * * * *